United States Patent [19]

Onushco

[11] 4,167,400

[45] Sep. 11, 1979

[54] ELECTRODE RESTRAINING ASSEMBLY IN AN ELECTROSTATIC PRECIPITATOR

[75] Inventor: Andrew J. Onushco, Lebanon, Pa.

[73] Assignee: Envirotech Corporation, Menlo Park, Calif.

[21] Appl. No.: 928,634

[22] Filed: Jul. 27, 1978

[51] Int. Cl.[2] ..... B03C 3/04

[52] U.S. Cl. ..... 55/146; 55/151

[58] Field of Search ..... 55/140, 143–148, 55/150–157

[56] References Cited

U.S. PATENT DOCUMENTS

| | | | |
|---|---|---|---|
| 1,252,183 | 1/1918 | Schmidt et al. | 55/147 |
| 3,686,829 | 8/1972 | Stocker | 55/151 |
| 3,719,031 | 3/1973 | Gelfand | 55/148 |
| 3,972,701 | 8/1976 | Teel | 55/146 |

OTHER PUBLICATIONS

Buell Electrostatic Precipitators–Envirotech Brochure E P 202/0676/Ri dated 1974, p. 4.

*Primary Examiner*—Bernard Nozick

*Attorney, Agent, or Firm*—William S. Bernheim; John J. Morrissey

[57] ABSTRACT

An assembly for restraining emitting electrodes (14) in an electrostatic precipitator of the type having collecting electrodes (12, 13) arranged in rows spaced at equal distances in parallel planes and spaced-apart emitting electrodes (14) hung in rows centrally between adjacent collecting electrodes (12, 13), such assembly including a rigid electrically-conductive grid (16) suspended from and maintaining the mutual spacing of the emitting electrodes (14), non-conductive rods (34) attached to and extending out from the grid (16) toward the walls (10) of the precipitator, and non-conductive plates (38) attached to the walls (10) interposed between the ends of the respective rods (34) and the walls (10).

2 Claims, 1 Drawing Figure

ELECTRODE RESTRAINING ASSEMBLY IN AN ELECTROSTATIC PRECIPITATOR

BACKGROUND OF THE INVENTION

1. Field of Invention

The present invention relates to an assembly for restraining emitting electrodes in an electrostatic precipitator, and more particularly to such an assembly within an electrostatic precipitator of the type having collecting electrodes arranged in rows spaced at equal distances in parallel planes and spaced-apart emitting electrodes hung in rows centrally between adjacent collecting electrodes.

2. Description of the Prior Art

In the art of electrostatic precipitation it is conventional to provide a housing for the collecting and emitting electrodes, the walls of which housing are constructed of conductive metallic material and grounded. The housing defines an inlet for admitting a particulate-carrying gas and an outlet for discharging such gas reduced in particulate concentration. The precipitator further includes means for providing an electrical potential between the emitting electrodes and the collecting electrodes to create electrical field forces such that particulates in the gas are moved as a result to the collecting electrodes.

In more detail, by groups the emitting electrodes are commonly suspended from an upper supporting frame which is mounted in an insulated manner to the housing. The lower ends of the emitting electrodes are loaded by tensioning weights and retained parallel to and at uniform distances from one another by means of conductive restraining assemblies including a spacing grid supported by and in contact with the electrodes adjacent their lower ends. A number of separating grids are employed in the housing. Each grid typically spans the width of the precipitator and normally has a depth in the direction of gas flow equal to two or more emitting electrodes.

In addition to the above restraining function, the grids prevent the tensioning weights from falling should an emitting electrode break. Further, the grids are commonly constructed of conductive material so that the electrodes in each respective group of retained emitting electrodes are at the same potential.

When the grids are conductive, the restraining assemblies include means to restrict movement of each grid within the precipitator housing and to insulate the grid from the walls of the precipitator housing. As such means, assemblies have included positioning rods constructed of non-conductive material, for example, ceramic and mounted to extend horizontally from the grid toward the walls of the precipitator housing. This approach has not proved entirely satisfactory because during operation of the precipitator, a surface accumulation of dust and grime forms on the rods and at some point the accumulation becomes sufficient to serve as an electrical path by which the grid is shorted to the precipitator wall. Such shorting necessitates costly shutdowns of the precipitation for removal of the accumulation before the emitting electrodes associated with the grid can be put into full service again.

OBJECT OF THE INVENTION

It is an object of the present invention to provide an approved restraining assembly to, thereby, increase the time interval betweeh shutdowns of an electrostatic precipitator necessitated by accumulation of dust and grime on positioning rods of a restraining assembly which is employed to position emitting electrodes.

BRIEF DESCRIPTION OF THE FIGURE

Further objects and advantages of the invention will be apparent from the following detailed description, taken in conjunction with the accompanying drawing illustrating a preferred embodiment of the invention. The enclosed FIGURE is a perspective view of a portion of an electrostatic precipitator according to the present invention.

DETAILED DESCRIPTION OF A PREFERRED EMBODIMENT

Figure 1:
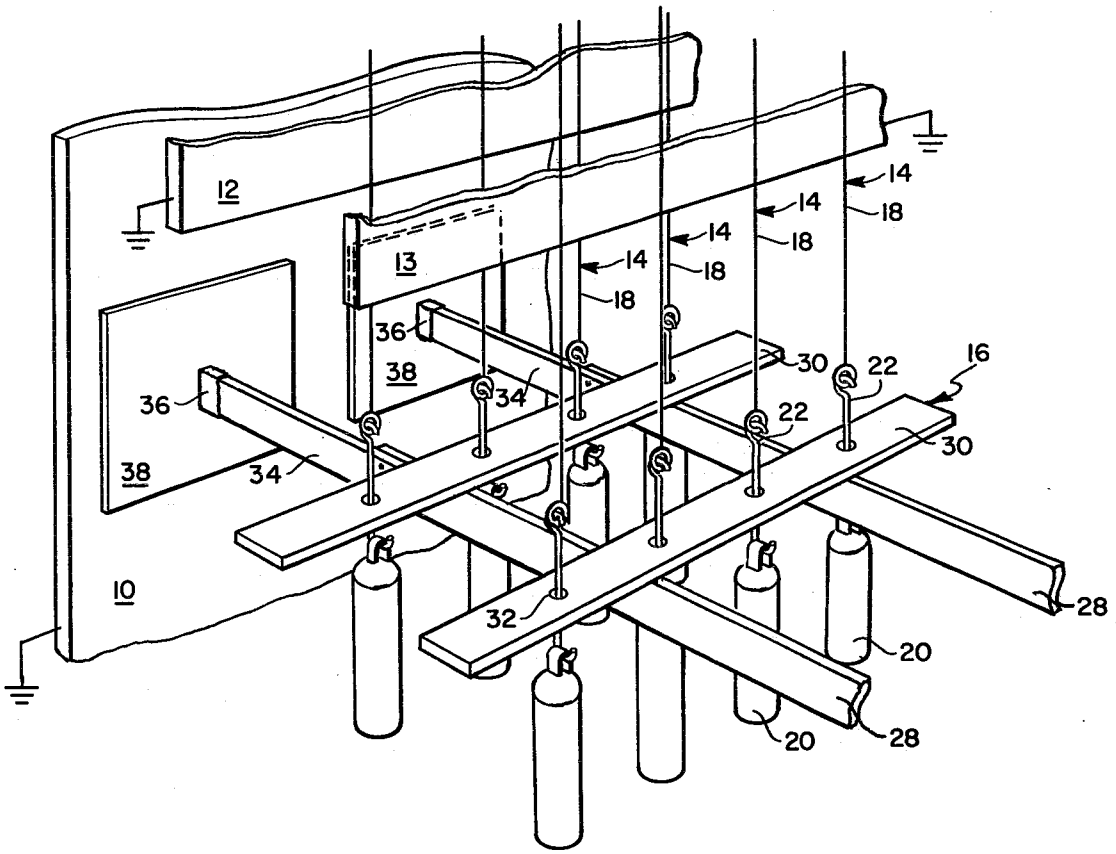

In the FIGURE, a portion of an electrostatic precipitator adjacent a sidewall 10 of the housing of the precipitator is shown. Major components of the precipitator are the sidewall 10 which is grounded, the lower portion of two collector electrode plates 12 and 13 which are mounted to the housing and grounded, the lower portion of a plurality of spaced-apart hanging emitting electrodes 14 suspended in an insulated way from the roof of the housing, and a restraining assembly including a rigid spacing grid 16 mounted in suspension in the housing from a plurality of emitting electrodes 14 whose movement is thus restrained.

As illustrated, the emitting electrodes 14 include wires 18 tensioned with weights 20. Alternatively, the emitting electrodes 14 can include rigid wire or rods in which event weights are unnecessary. The weights 20 are attached to the wires with hooks 22 extending from the tops of the weights 20. For operational efficiency, the wires 18 should be kept in parallel one to the other and the spacing of the wires 18 between adjacent collecting plates 12 maintained by employing a restraining assembly; however, absolute rigidity is not provided because rapping is typically employed to dislodge dust accumulation on the emitting electrodes 14.

As mentioned above, the spacing grid 16 retains the emitting electrodes 14 in parallel one to the other. The illustrated grid 16 extends horizontally in the housing and has two bars 28 which span in parallel from side to side across the housing and cross strips 30 attached to the bars 28 at the spaced intervals of the rows of emitting electrodes 14. In the illustrated embodiment, the cross strips 30 include apertures 32 through which the hooks 22 securing the weights 20 to the wires 18 extend.

To limit translational movement of the spacing grid 16, the restraining assembly includes positioning rods 34 extending generally horizontally out from the ends of the bars 28 or from the cross strips 30 towards the sidewalls 10 of the housing. Alternatively, the bars 28 or cross strips 30 may themselves extend outward to abut the sidewalls 10.

Further, the spacing grid 16 is formed from electrically conductive material and connected to the emitting electrodes 14 such that the electrodes 14 and grid 16 are in electrical contact at the same potential. As a consequence, the grid 16 is insulated from the grounded sidewalls 10. For this purpose the positioning rods 34 are formed from non-conductive material. In practice, a clearance of about 2 cm is provided between the end of the positioning rods 34 and a plate 38, hereafter described, attached to the sidewalls 10 to assure the grid 16 is in suspension from the emitting electrodes 14. A shock absorber 36, such as an asbestos pad, is attached to the end of the positioning rods 34 to absorb jolts to prevent breakage of the positioning rods 34 which are normally brittle.

To further insulate the spacing grid 16, the restraining assembly further includes plates 38 which are vertically attached face to face to the interior surface of the sidewalls 10 and which are interposed between ends of the respective positioning rods 34 and the sidewalls 10 so that the ends of the rods 34 abut the plates 38. The plates 38 are fabricated from non-conductive material and have a surface area substantially larger than the cross sectional area of the positioning rods 34 at their outer end. The illustrated plates 38 are rectangular but other shapes such as circular are as useful. The purpose of the plates 38 is to prevent an electrical arc from shorting the associated emitting electrodes 14 by jumping from an electrically conductive accumulation on a positioning rod 34 directly to the sidewall 10. With a plate 38 present, for a short to occur along the associated positioning rod 34, an arc must reach from the positioning rod 34 to the sidewall 10 beyond the edges of the plate 38.

During operation of the precipitator, the spacing grid 16 maintains the mutual spacing of the emitting electrodes 14 and the spacing of the emitting electrodes 14 from the collector plates 12. The positioning rods 34 abut the plates 38 attached to the sidewalls 10 to limit the translational movement of the grid 16 to which the rods 34 are attached. The insulative plates 38 interposed between the sidewalls 10 and respective positioning rods 34 decrease the possibility of shorting along the positioning rods 34 resulting from dust and grime accumulating on the positioning rods 34.

I claim:

1. In an electrostatic precipitator of a type having a housing formed with walls defining an inlet for admitting a particulate carrying gas and an outlet for discharging such gas reduced in particulate concentration, collecting electrodes mounted in the housing spaced apart from one another and extending in parallel, and spaced-apart emitting electrodes suspended in the housing in rows between adjacent collecting electrodes; a restraining assembly comprising:

(a) an electrically-conductive rigid grid which extends horizontally within said housing and is supported by, and in electrical contact with, a plurality of the emitting electrodes adjacent their lower ends to maintain the mutual spacing of such emitting electrodes;

(b) positioning members mounted to said grid to extend horizontally therefrom toward the walls of the housing to restrict movement of the grid, said positioning members being formed of electrically non-conductive material; and (c) plates of non-conductive material mounted vertically to the housing walls face to face therewith, and positioned so that each end of each one of said positioning members abuts a corresponding one of said plates to electrically insulate the grid from the housing walls, the surface area of each of said plates being substantially larger than the cross-sectional area of the abutting end of the positioning member adjacent thereto.

2. The restraining assembly of claim 1 further including shock absorber means attached to the ends of said positioning members adjacent said plates.

* * * * *